United States Patent [19]

Krambrock et al.

[11] 4,194,845

[45] Mar. 25, 1980

[54] METHOD AND APPARATUS FOR MIXING LOOSE MATERIAL

[75] Inventors: Wolfgang Krambrock, Vogt; Paul Lübbehusen, Ravensburg, both of Fed. Rep. of Germany

[73] Assignee: Waeschle Maschinenfabrik GmbH, Ravensburg, Fed. Rep. of Germany

[21] Appl. No.: 944,712

[22] Filed: Sep. 22, 1978

[30] Foreign Application Priority Data

Sep. 23, 1977 [DE] Fed. Rep. of Germany ..... 2742904

[51] Int. Cl.[2] ..... B01F 15/02; B01F 13/02; B01F 5/12

[52] U.S. Cl. ..... 366/159; 366/101; 366/262

[58] Field of Search ..... 366/101, 159, 341, 262, 366/152, 184, 192, 193, 9, 14, 65, 91, 96

[56] References Cited

U.S. PATENT DOCUMENTS

| | | | |
|---|---|---|---|
| 3,106,385 | 10/1963 | Arthur | 366/101 |
| 3,145,975 | 8/1964 | Towns | 366/159 |
| 3,351,326 | 11/1967 | Alberts | 366/101 X |
| 3,361,413 | 1/1968 | Heyl | 366/159 X |
| 3,583,681 | 6/1971 | Brown | 366/159 |
| 3,995,771 | 12/1976 | Olivier | 366/101 |

FOREIGN PATENT DOCUMENTS

| | | | |
|---|---|---|---|
| 630542 | 11/1961 | Canada | 366/341 |

*Primary Examiner*—Edward J. McCarthy
*Attorney, Agent, or Firm*—Michael J. Striker

[57] ABSTRACT

Material to be mixed is fed into the upper portion of a container from where the material descends by means of the force of gravity. The container is provided with a partition extending across the interior of the container and operative to divide the descending material into two separated substreams. The container is further provided with two outlets which are adjustable so as to separately control the respective speeds of descent of the material of the two substreams in the container. The material which is withdrawn at the lower portion of the container is returned back to the upper portion of the container for further mixing. Because of the two substreams in the container, the relative elevations of arbitrarily selected samples, located in respective ones of the substreams, changes during material descent, thereby improving mixing action.

19 Claims, 9 Drawing Figures

FIG. 2
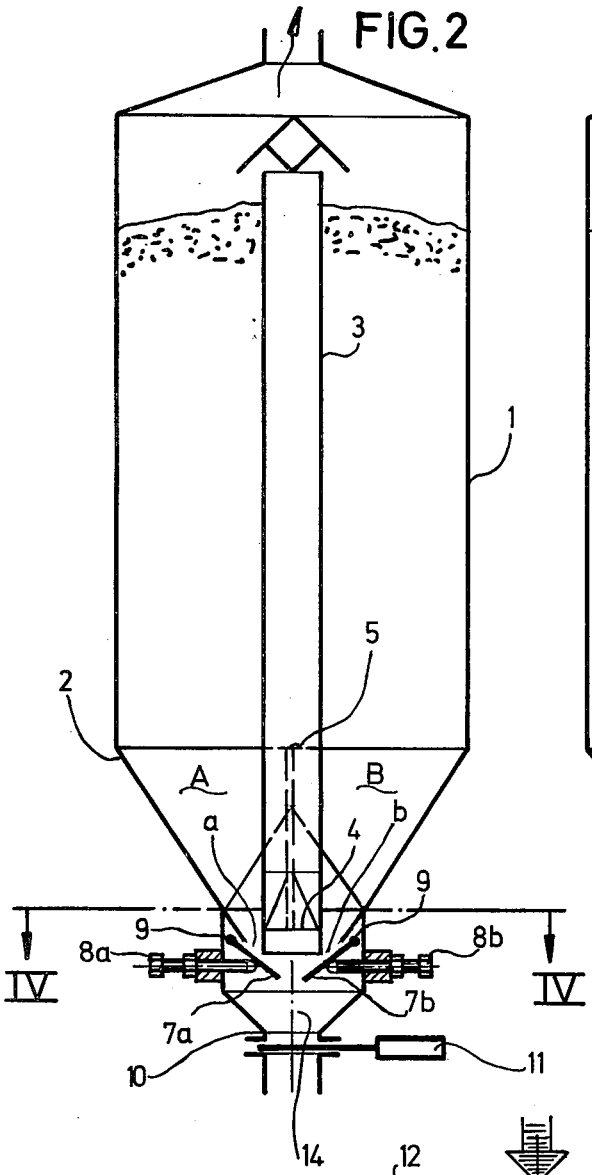
FIG. 3
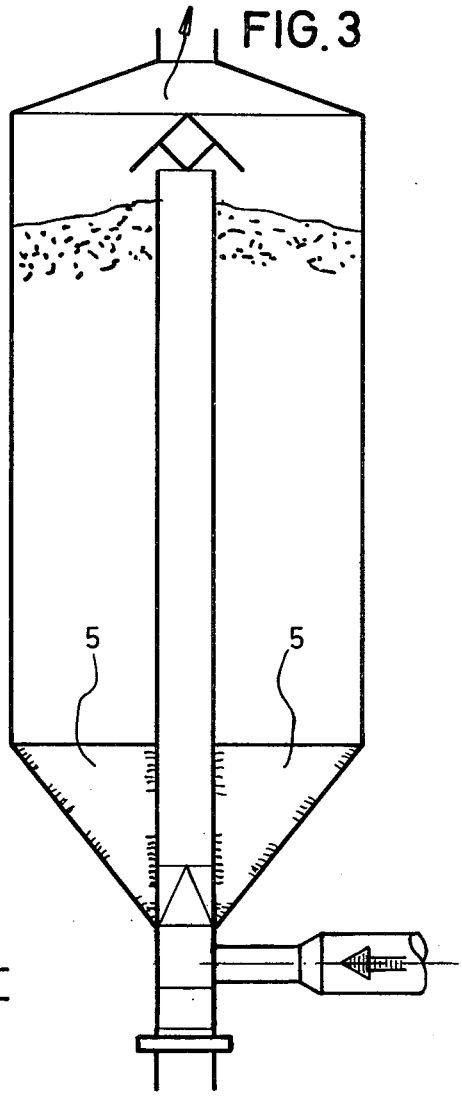
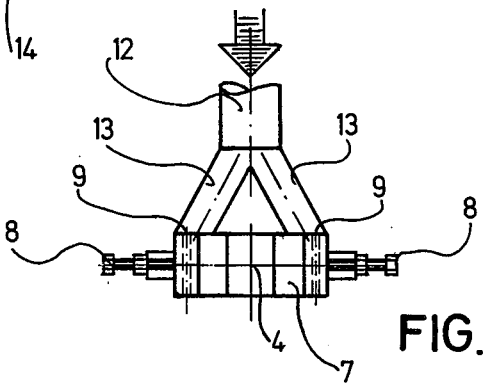
FIG. 4

METHOD AND APPARATUS FOR MIXING LOOSE MATERIAL

BACKGROUND OF THE INVENTION

The present invention relates to a method and an apparatus for mixing loose material. More particularly, the present invention concerns mixing pulverulent or granular material.

It is known in the art, in order to mix the material in a container, to circulate by means of gas the material from the bottom of the container to the upper part thereof through a riser pipe.

It is known from experience that relatively good mixing results can be obtained using such devices only if the material to be mixed is circulated in the container from 10 to 20 times. Clearly, the result of using such devices is that too long a time is necessary to mix the material.

Another type of a mixing apparatus is known (see German Pat. Nos. 1,937,374 and 2,219,397) where in order to improve the longitudinal mixing the material fed into the riser pipe is withdrawn from two different portions of the material-columns at two different elevations and is fed in to the riser pipe through two ring channels of different respective elevation. The mixing time in such an apparatus is considerably reduced compared with the first mentioned technique, that is such an apparatus requires only two to five circulations of the material within the container. The shortest possible mixing time in such an arrangement depends upon the flowability of the material. Thus, the width of the ring channel(s) must be selected empirically in accordance with the particular material to be mixed. In the known arrangements changes of the ring-channel cross-section are possible only by axial displacement of the riser pipe. Such displacements presuppose structural complexity and expense. This is especially true when relatively large quantities of material are to be mixed. In relatively large containers having a volumetric capacity of 500 $m^3$, the diameter of the riser pipe is up to about 1000 mm and the length up to about 30 m. Clearly such a pipe is rather difficult to precisely displace.

SUMMARY OF THE INVENTION

It is a general object of the present invention to avoid the disadvantages of the prior art methods and arrangements for mixing loose material.

More particularly, it is an object of the present invention to provide such a method and an apparatus for this method of mixing loose material, which method would render it possible to vary the flow rate of the movable material thereby obtaining considerably better mixing properties, and still in very short mixing time.

In pursuance of these objects and others which will become apparent hereafter, one feature of the present invention resides in providing a method of mixing loose material in a container, which method includes the steps of feeding material to be mixed into the upper part of a mixing container and withdrawing material by means of the force of gravity at the lower part of the container whereby the material in the container descends, dividing the descending material in the interior of the container into two separated substreams. The rates at which the material of the descending substreams is withdrawn at the lower part of the container are separately controlled such that the respective speeds of descent of the material of the two substreams in the interior of the container differ, whereby the relative elevations of samples of material in the two substreams change during such descent. The material thus withdrawn is returned back into the upper part of the container for further mixing.

According to a further concept of the present invention, an apparatus for mixing comprises a hollow elongated container adapted to be fed with material to be mixed and having an upper portion receiving the material and a lower portion. The material descends from said upper to said lower portion by means of the force of gravity. The apparatus is further provided with means for dividing the descending material in the interior of the container into two separated descending substreams and for controlling the rates at which the material of the descending substreams is withdrawn at the lower portion of the container adjustably such that the respective speeds of descent of the material of the two substreams in the interior of the container differ, whereby the relative elevation of samples of material in the two substreams change during such descent. The apparatus is also provided with means for returning the thusly withdrawn material back into the upper portion of the container for further mixing.

Due to the different respective speeds of descent of the material of the two substreams, it becomes possible to obtain not only good cross mixing of the material but also the desired high quality of longitudinal mixing.

Inasmuch as the present invention permits withdrawing of the material from the bottom part of the container, rather than from a portion somewhere in the middle of the container, it ensures especially high quality of mixing regardless of differences in materials to be mixed.

Certainly, the two substreams of material can be returned separately back into the upper part of the container without a loss of mixing effectiveness; however, it is simpler and therefore more advantageous to mix the two substreams together and then pneumatically (or by other means) return the thusly mixed material upwardly for further mixing.

In accordance with another advantageous feature of the present invention the apparatus is provided with two separate outlets at the lower part of the container. The cross-section of each of the outlets is adjustable so as to vary the amount of the passing material and thus obtaining better mixing results. This feature makes it possible to eliminate any awkward displacement of the riser pipe or complicated internal mechanisms. Moreover, the cross-section of the outlets can be adjusted relative to each other to thereby vary the rate of material removal not only absolutely, that is depending upon the material to be mixed, but also relatively between the two outlets. These outlets can, when necessary, be closed completely and their cross-sectional areas can be adjusted continually or intermittently.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a longitudinal cross-section of one apparatus according to the invention;

FIG. 3 is another longitudinal cross-section of the apparatus shown in FIG. 2;

FIG. 4 is a sectional view of a part of the apparatus taken along the line IV—IV in FIG. 2;

DESCRIPTION OF THE PREFERRED EMBODIMENTS

Figure 1:
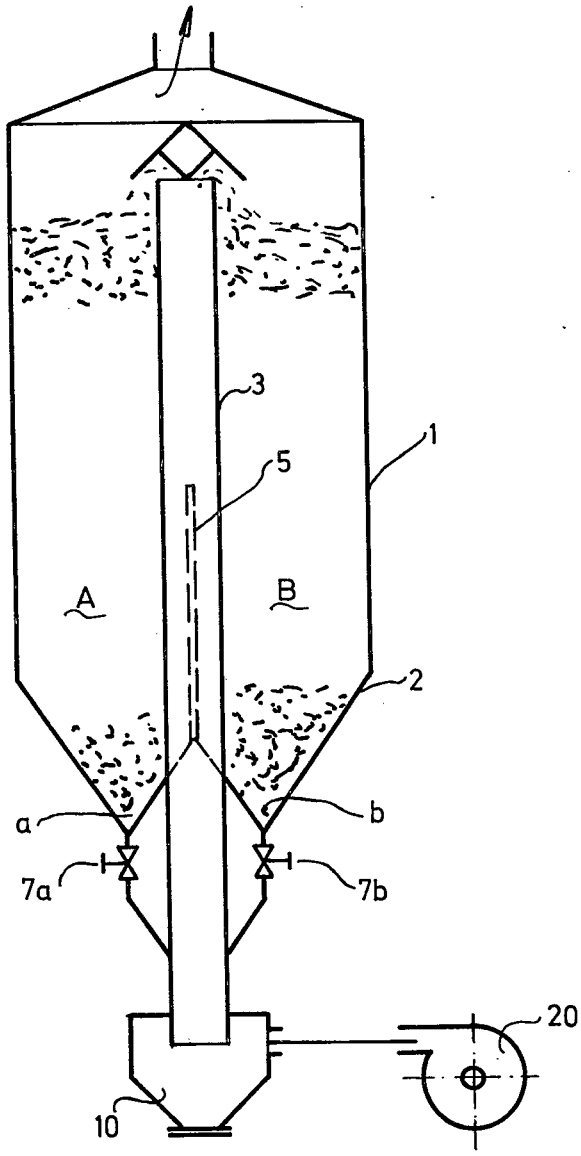
FIG. 1 is a schematic view of an apparatus for mixing loose material, in accordance with the present invention.

Referring now to the drawings and first to FIG. 1. thereof, reference numeral 1 denotes a cylindrical container which has a conical lower part 2 and an axial riser pipe 3. The lower part of the container is provided with a dividing portion 5 which divides the interior of the container into two compartments A and B. Each of the compartments is provided with a separate outlet a and b respectively. The outlets a and b are shown in FIG. 1 schematically and each is provided with a controlling device 7*a* and 7*b* respectively. The material to be mixed descends towards lower part 2 of the container 1 by means of the force of gravity and is subdivided by the partition 5 into two substreams in the compartments A and B. By changing the cross sections of the outlets a and b it is possible to vary the rates of descent of the material in compartments A and B. The material then is returned back through the riser pipe 3 from the lower part 2 towards the upper part of the container 1 by means of a blower 20. By establishing different rates of descent in the two compartments, it becomes possible to obtain very high mixing effectiveness in the longitudinal direction of the container 1. Only two or three circulations of the material to be mixed in the container 1 may be sufficient to activate the mixing which can not be improved by further circulation. When desired, the mixed material can be withdrawn from the container through the outlet 10, with the blower 20 turned off beforehand.

The principle of the present invention is employed in different embodiments, which will now be described in detail. Thus, the substreams of the material can be returned back into the upper part of the container not separately but together as one stream which is structurally simpler. Also, the container can be subdivided into more than two compartments, similar to A and B, and each should in that case have a respective outlet similar to a and b shown in FIG. 1. It is to be understood that such a construction is especially advantageous with regard to obtaining the better mixing action when the container is of large diameter. The riser pipe may of course be mounted excentrically in the container, because the location of the riser pipe is not problematic when carrying out the method of the present invention.

FIGS. 2 through 4 show a preferred embodiment of the mixing container in accordance with the present invention. In this embodiment the riser pipe 3 is shown to have a circular cross section through most of its length. Only the lowest portion 4 of the pipe 3 has a rectangular or quadratic cross section. The lower part of the container likewise terminates in a similar rectangular cross section. Self-evidently, the riser pipe 3 as well as the container 1 can have any desired cross-sectional configuration, that is quadrangular, rectangular, prismatic, etc. The dividing partition 5 fixedly connects the riser pipe 3 with the inner wall of the container 1, thus bounding the compartments A and B. Two parallel flanges of the lower end of the rising pipe 3 and the inner section of the lower part 2 of the container 1 define two opposite passages a and b which communicate with the compartments A and B respectively. The passages a and b are provided with flaps 7*a* and 7*b* respectively, which covers are pivotable about horizontal axes 9. The flaps are each provided with respective means for adjusting the setting of the flap. In the embodiment shown in FIG. 2 these means are adjusting screws. However, instead of screws there can be employed pneumatic, electromagnetic or motor-driven displacing arrangements. It is especially advantageous to use one of these latter adjusting arrangements when the flaps 7*a*, 7*b* serve simultaneously as the cover or gate for the bottom outlet 10 of the container 1. In the embodiment shown in FIG. 2, however, for this purpose there is employed a final closing member 11, which, should the filling and mixing process be over, will open the container for emptying the latter.

The air flow used to return the material for further mixing back into the upper part of the container is supplied into the space 14 which is located below the lower end of the riser pipe 3 and above the closing member 11 through a tubular conduit 12. The conduit 12 shortly before entering into the space 14 is divided into two passages 13.

Figure 5:
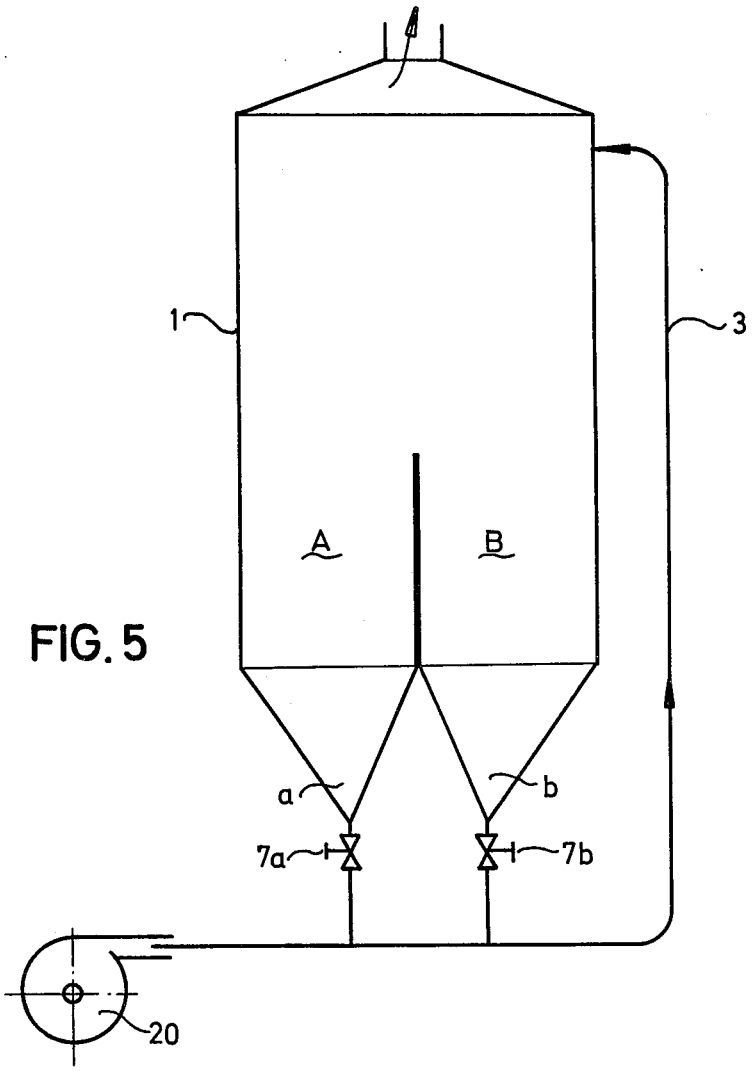
FIG. 5 is a schematic view of another embodiment of the apparatus in accordance with the present invention.

FIG. 5 shows another embodiment of the container shown in FIG. 1. This embodiment has a riser pipe extending outside the container 1. Such embodiment is advantageous when a simple storage container is to be converted into a mixing container.

Figure 6:
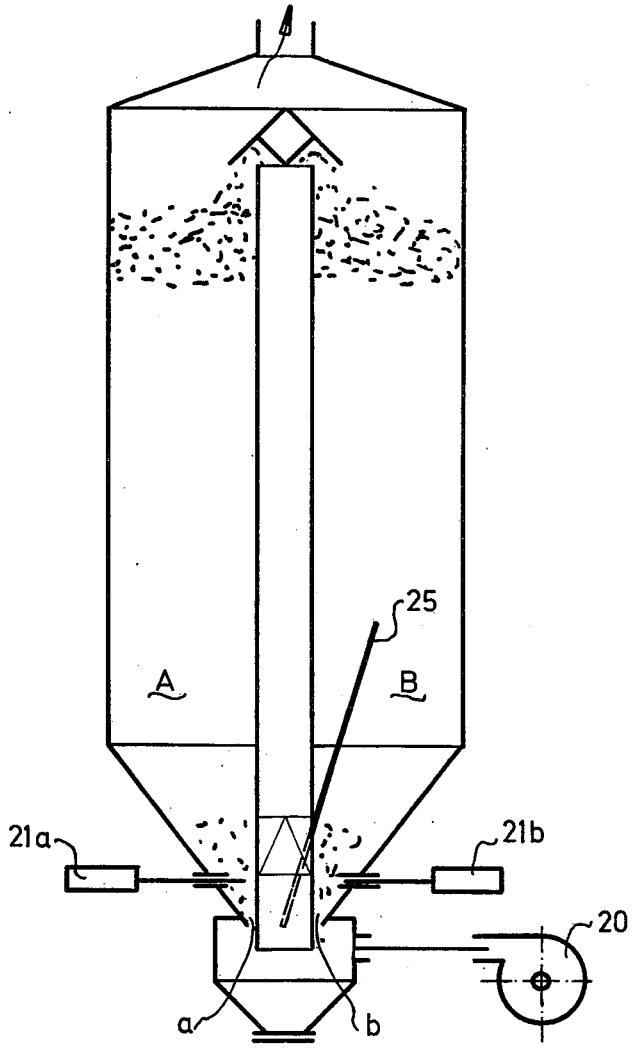
FIG. 6 is a schematic view of a modified version of the embodiment shown in FIG. 2.

FIG. 6 shows still another embodiment of the container shown in FIG. 2. The controlling devices for regulating the cross-sections of the passages a and b in accordance with this embodiment are provided with flat-slide valves 21*a* and 21*b*, respectively. Another advantageous feature of this embodiment resides in providing a tiltable dividing partition 25. This renders it possible to change the volume of the compartments A and B in order to vary the relation between the two rates of material descent in this way too. It is possible due to the tiltable partition 25 to activate the improved longitudinal mixing of the present invention even when the outlets a and b are set to equal cross-sectional areas.

Figure 7:
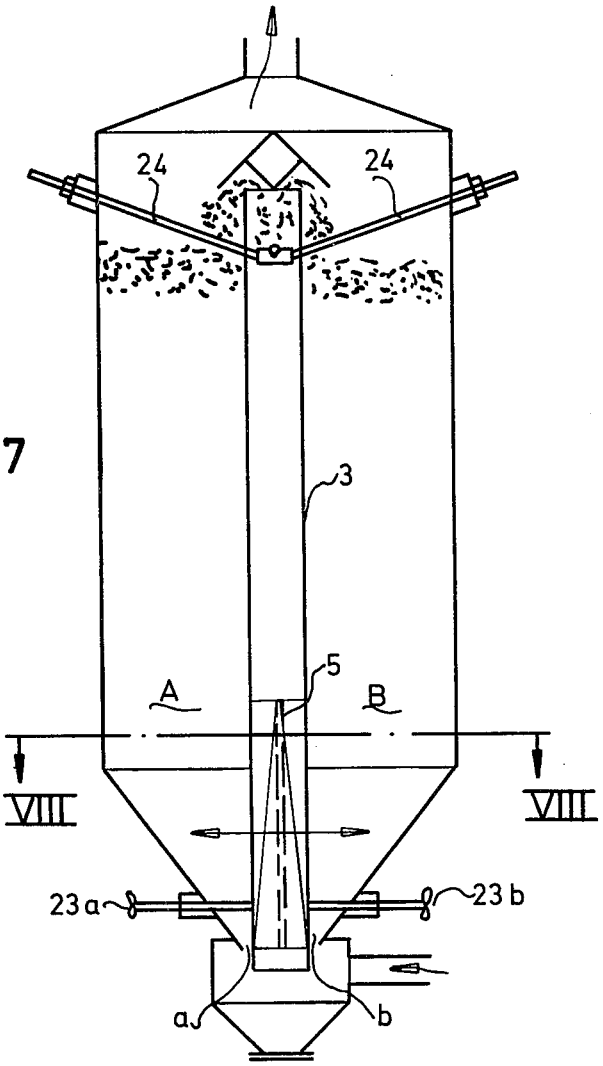
FIG. 7 is a schematic view of a further embodiment of the apparatus.
Figure 8:
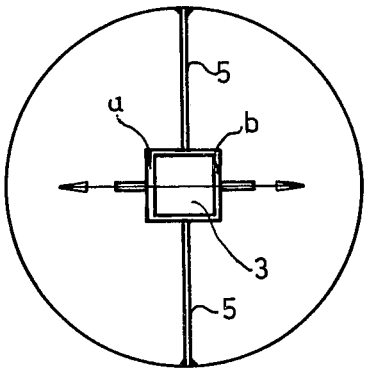
FIG. 8 is a sectional view taken along line VIII—VIII in FIG. 7.

FIGS. 7 and 8 show another way of achieving the different respective rates of descent of the material in the plural compartments A, B. The upper portion of the riser pipe 3 is provided with rods 24 which serve to tiltably mount the riser pipe 3 relative to the longitudinal axis of the container 1. The lower portion of the pipe 3 is provided with the adjusting devices 23*a* and 23*b* respectively which are movable in the direction designated by the arrow, so as to keep the combined cross section of the two outlets a and b constant and still changing the cross section of the outlets relative to each other. In order to change the combined cross section of the outlets the riser pipe 3 can be longitudinally shifted vertically upwards. It is to be mentioned, however, that such a solution is not advisable when the mixing containers are very tall.

Figure 9:
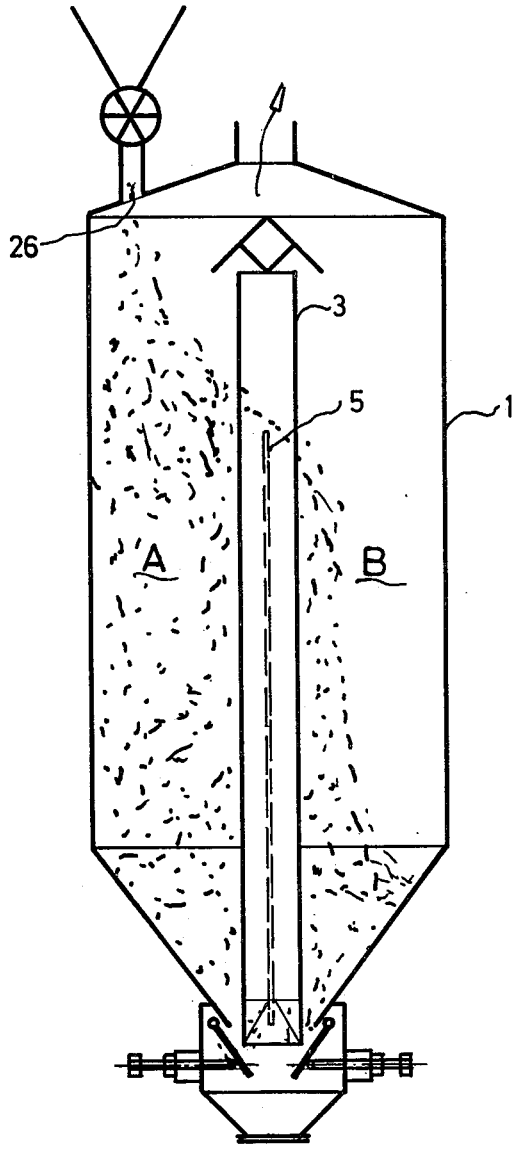
FIG. 9 is a schematic view of a yet further modification of the apparatus shown in FIG. 2.

FIG. 9 shows still another embodiment of the container shown in FIG. 2, and which is designed to considerably minimize the required mixing time. In this embodiment the container 1 is provided with an off-center inlet 26 which is located above compartment A. As shown in FIG. 9, the compartment A is the first to be filled. In this way, a first longitudinal mixing action occurs even during the course of initially filling the container 1, i.e. filling compartment A first and then compartment B. Thus, for example, if the container 1 is to be filled with component X and then with component Y, then depending on the relative amounts of the two components, at least a portion of the component Y in the compartment B will be located at the same height as component X in compartment A.

It will be understood that each of the elements described above, or two or more together, may also find a useful application in other types of a method and apparatus for mixing a loose material differing from the types described above.

While the invention has been illustrated and described as embodied in a method and apparatus for mixing a loose material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for mixing loose material, comprising an elongated container adapted to be fed with material to be mixed and having an upper portion receiving the material and a lower portion, the material descending from said upper portion to said lower portion; outlet means on said lower portion of said container for withdrawing the material from the latter; means for returning the thusly withdrawn material back into the container for further mixing, and including a rise pipe mounted in said container and having a lower open end receiving the material from said outlet means and an upper open end discharging the material into the interior of the container; and means for tilting said riser pipe relative to the vertical for varying the rate of descent of the material in said container.

2. An apparatus for mixing loose material, comprising an elongated container, having a peripheral wall and being adapted to be fed with material to be mixed, said container having an upper portion receiving the material and a lower portion, the material descending from said upper portion to said lower portion; outlet means for withdrawing the material from the container, and including at least one outlet formed at said lower portion of said container by a part of said peripheral wall; and means for returning the thusly withdrawn material into the upper portion of the container for further mixing, and including a riser pipe mounted in said container and having a lower open end receiving the material from said outlet means and an upper open end discharging the material into the interior of the container, said riser pipe having at a lower region thereof an outer surface which defines said one outlet together with said part of said peripheral wall at said lower portion of the container.

3. An apparatus as defined in claim 2, and further comprising means for dividing the desceding material in the interior of the container into two separated descending substreams, and for controlling the rates at which the material of the descending substreams is withdrawn at the lower portion of the container adjustably such that the respective speeds of the descent of the material of the two substreams in the interior of the container differ, whereby the relative elevations of samples of material in the two substreams change during such descent.

4. An apparatus as defined in claim 2, wherein said riser pipe extends substantially vertically in said container.

5. An apparatus as defined in claim 4, wherein said lower end of a rising pipe has a rectangular cross section.

6. An apparatus as defined in claim 3, wherein said dividing means include at least one partition mounted in the interior of the container for dividing the same into two compartments.

7. An apparatus as defined in claim 6, wherein wherein each of said compartments has the respective outlet at the lower portion of the mixing container.

8. An apparatus as defined in claim 7, wherein said dividing means still further include means for varying the cross sections of said outlets to thereby control the respective speeds of descent of the material of the two substreams.

9. An apparatus as defined in claim 7, wherein said returning means further include a blower operative to direct the substreams leaving said outlets into the lower end of said riser pipe and further up and out said upper open end thereof into the upper part of the container.

10. An apparatus as defined in claim 9 wherein said lower part of said container has a conical shape.

11. An apparatus as defined in claim 8, wherein said varying means include covers each mounted for selective pivotable movement between a first position in which it closes the respective outlet and a second position in which it opens the same.

12. An apparatus as defined in claim 11, wherein each cover is provided with separate driving means.

13. An apparatus as defined in claim 12, said container having an outlet passage provided at said lower part thereof, said covers being adapted when in said second position to open said outlets into said outlet passage to thereby permit material to leave the container.

14. An apparatus as defined in claim 8, wherein said varying means include throttle sliders.

15. An apparatus as defined in claim 6 wherein said two compartments have substantially equal dimensions.

16. An apparatus as defined in claim 6, wherein said partition connects said riser pipe to the inner wall of said container.

17. An apparatus as defined in claim 16, wherein said partition is inclined relative to the longitudinal axis of said container.

18. An apparatus as defined in claim 17, wherein said partition is adjustably tiltable in the interior of said container.

19. An apparatus as defined in claim 6, wherein said container has an inlet located above said partition.

* * * * *